United States Patent [19]

Wachter et al.

[11] Patent Number: 4,760,952

[45] Date of Patent: Aug. 2, 1988

[54] BULK BOX AND SLIP SHEET CONSTRUCTION

[75] Inventors: Richard G. Wachter, Batavia, Ill.; Rosario J. Schillaci, Spotswood, N.J.

[73] Assignee: International Paper Company, N.Y.

[21] Appl. No.: 30,524

[22] Filed: Mar. 27, 1987

[51] Int. Cl.[4] ..... B65D 5/72; B65D 5/48

[52] U.S. Cl. ..... 229/127; 229/163; 229/23 R

[58] Field of Search ..... 229/127, 163, 900, 165, 229/171, 915, DIG. 11, 169, 172, 174, 175, 183, 184, 45, 52 B

[56] References Cited

U.S. PATENT DOCUMENTS 4,037,775 7/1977 Bamburg et al. ..... 229/23 R 4,252,266 2/1981 Kupersmith ..... 229/23 R

*Primary Examiner*—Willis Little

*Attorney, Agent, or Firm*—Walt Thomas Zielinski

[57] ABSTRACT

A bulk box and slip sheet construction. The one piece paperboard blank from which the bulk box is formed has a plurality of main, side forming panels, the lower end of each foldably carrying a bottom forming panel. At least one of the bottom forming panels is provided with a slip sheet. The slip sheet is glued to at least one of the box bottom forming panels. One edge of the slip sheet, termed a clamping edge, extends from its bottom forming panel to a region beyond the fold line which connects this bottom forming panel to its respective side forming panel. After the blank has been erected, this clamping edge can be clamped to pull the box onto a slip sheet lift truck for transport and/or stacking. More than one slip sheet can be employed, or a longer single slip sheet, to thereby provide the bulk box with more than a single clamping edge portion.

4 Claims, 4 Drawing Sheets

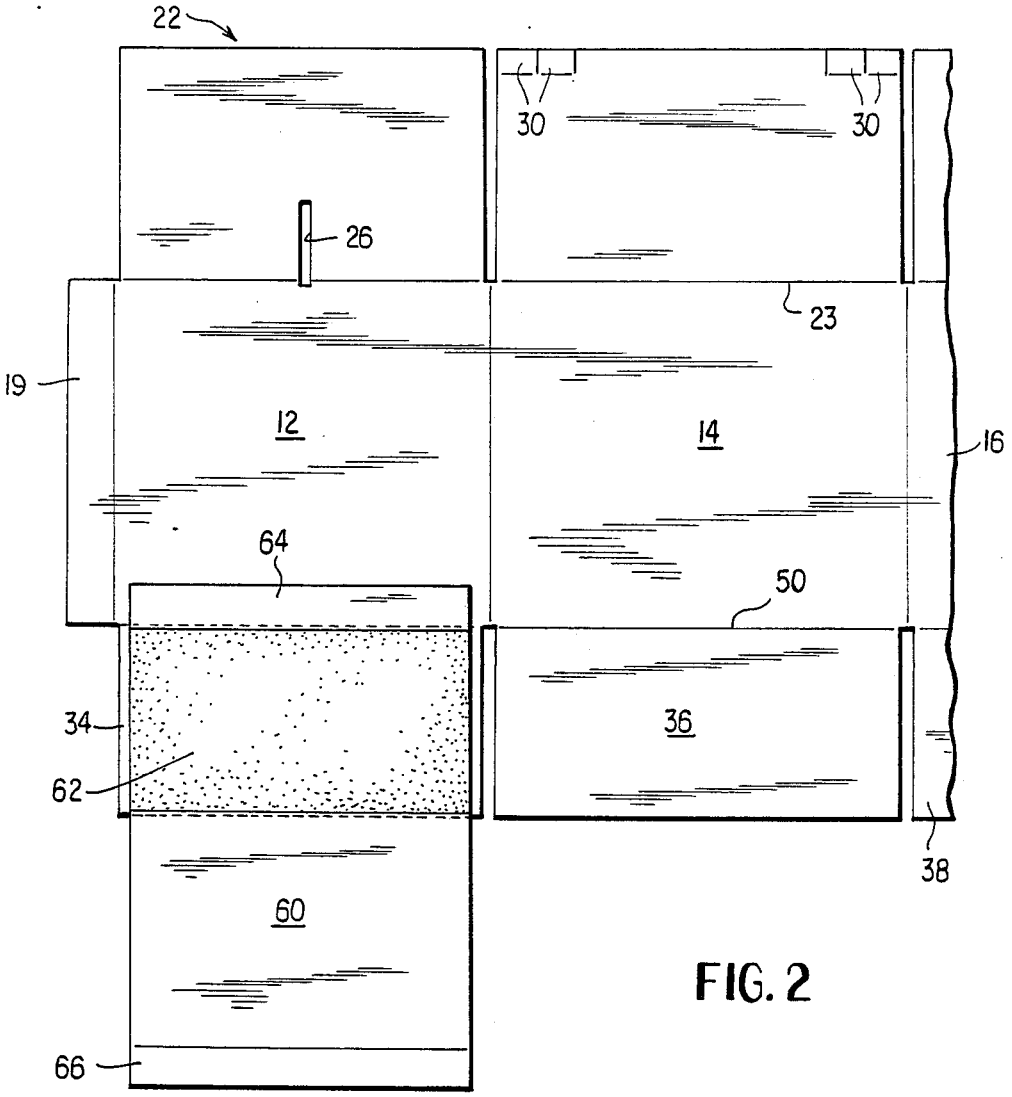
FIG. 2
FIG. 3
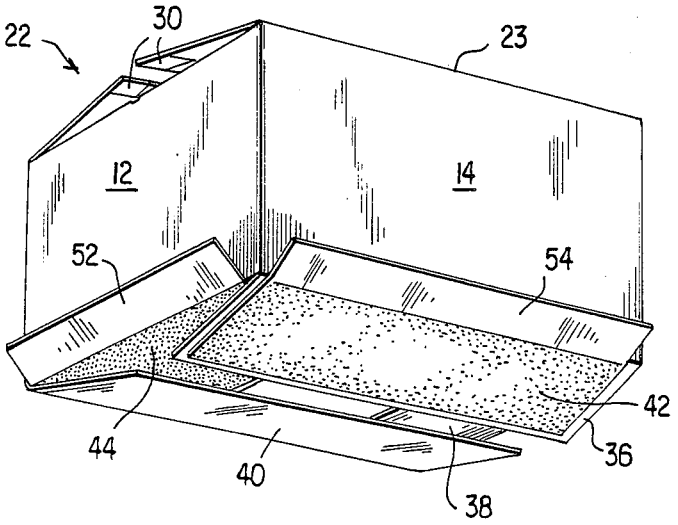

FIG. 4
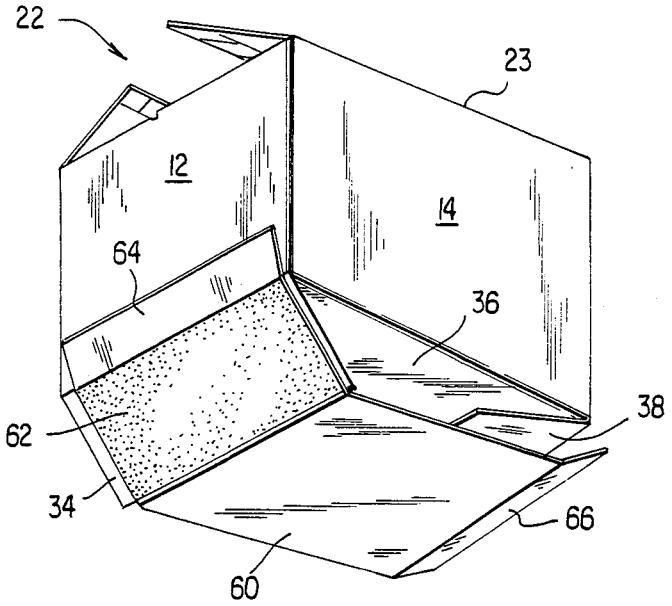
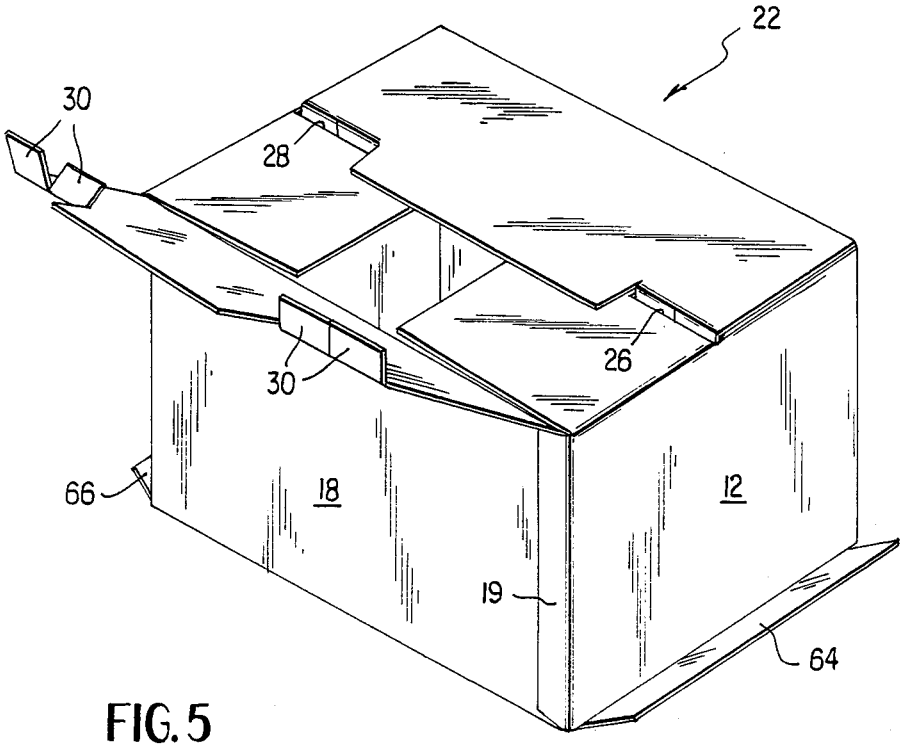
FIG. 5

BULK BOX AND SLIP SHEET CONSTRUCTION

BACKGROUND OF THE INVENTION

This invention relates to containers, and more particularly to large containers fashioned of corrugated paperboard or other similar resilient, stiff and foldable sheet stock. Very large containers fashioned of corrugated paperboard are often termed bulk boxes because of their size. Bulk boxes are well known in the packaging art and some exhibit the property of being collapsed prior to being filled, and also of being collapsed subsequent to emptying, for reshipment and reuse.

Those bulk boxes to which this invention relates are employed with slip sheets. As used in this art, a slip sheet is often a separate sheet of corrugated paperboard, or a sheet of fiber board, or any other unitary sheet which is placed beneath a bulk box, with a portion of the slip sheet, at least along one edge of the box, extending beyond a respective sidewall of the box so as to thereby define a clamping edge portion. A slip sheet lift truck, similar to a forklift truck, is provided with a clamp which engages the clamping edge portion of the slip sheet and pulls the slip sheet, together with the loaded bulk box thereon, onto the platform of the slip sheet lift truck. The bulk box may now be transported to another location, as for example, to a stacking location.

Slip sheets may also be used with conventional forklift trucks, with the forks of the forklift truck being insertable beneath the slip sheet.

In many of the prior art bulk box and slip sheet constructions, the slip sheet is either defined by an element completely separable from the bulk box, or is defined by an element which is a portion of the bulk box.

Examples of the use of forklift type trucks or slip sheet type trucks with bulk boxes associated with slip sheets may be seen by reference to U.S. Pat. Nos. 2,619,241 issued to Jessen; 3,142,399 issued to Oster; 3,666,128 issued to Shimizu; and, 3,850,115 issued to Mackes. Examples of bulk bin and slip sheet constructions may be seen from U.S. Pat. Nos. 4,037,775 issued to Bamburg et al; 4,138,053 issued to Gardner; and, 4,252,266, 4,358,048, 4,358,049, 4,405,077, and 4,596,355 all of which were issued to Kupersmit.

SUMMARY OF THE INVENTION

According to the practice of this invention, a bulk box and slip sheet construction is provided, the construction being such that the invention is capable of being carried out with box making apparatus already in use, and hence, the practice of the invention does not require the construction of substantially new apparatus for mass production of the bulk boxes. The bulk box of this invention is fashioned from a unitary blank of corrugated paperboard, the blank typically being glued and then formed into a collapsed tube. A slip sheet is glued to a portion of the blank or to a portion of the collapsed tube formed from the blank by glueing and folding, the collapsed tube with its attached slip sheet now ready for transport to the site of erecting the box and filling it. The slip sheet is thus, for practical purposes, integral with the box. Conventional box making apparatus may be employed to form the bulk box of this invention, and only apparatus required to glue the slip sheets to a portion of a blank is further required for mass production, it being understood that the attachment of the slip sheet may be done manually if desired. Accordingly, the invention not only provides a substantially integral slip sheet and bulk box combination, but further, makes possible the practical realization of this combination with a minimum of expense.

The blank from which the bulk box of this invention is formed is termed a regular slotted container box blank, known in this art as an RSC blank, a type of blank for which numerous blank forming machines are capable of producing.

DESCRIPTION OF THE DRAWINGS

FIG. 2 is a partial view, similar to FIG. 1, and shows an embodiment with a longer form of slip sheet.

FIG. 3 is a perspective view looking from the bottom of the partially erected and closed bulk box of this invention and illustrates how the blank shown at FIG. 1 is employed.

FIG. 4 is a view similar to FIG. 3, and shows how the modification of FIG. 2 is employed.

FIG. 5 is a perspective view of the erected blank of FIG. 2 looking from the top.

DETAILED DESCRIPTION OF THE INVENTION

Figure 1:
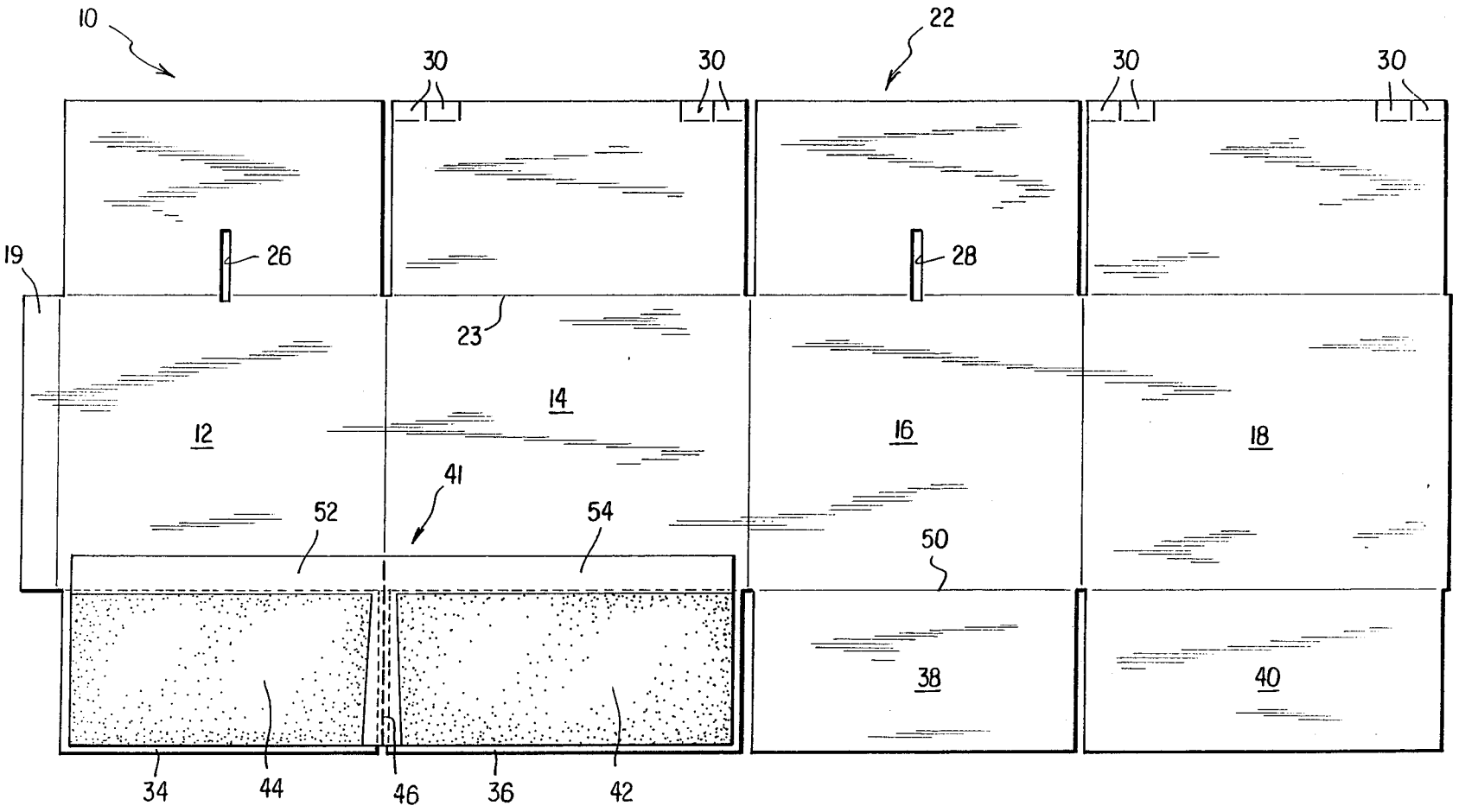
FIG. 1 is a plan view of the blank from which the bulk box is formed, together with a pair of generally rectangular slip sheets which are glued to a portion of the blank.

Referring now to FIG. 1 of the drawings, the numeral 10 denotes generally the blank and slip sheet combination of this invention. The blank is defined by a series of side wall forming and rectangular panels 12, 14, 16 and 18, joined edge-to-edge along the indicated foldable lines with numeral 19 denoting the usual manufacturer's flap. The flap 19 is shown as extending from panel 12, although clearly it could also extend from panel 18. The numeral 22 denotes a series of upper closure forming panels, integrally formed from the main panels 12, 14, 16 and 18 and attached to these panels by the indicated fold line 23 extending longitudinally of the blank. The minor top forming panels are provided with slots 26 and 28, respectively, while alternate major top forming panels are provided with tabs 30 at their corners. It will be understood that the top of the bulk box of this invention may be closed by the indicated top forming panels, or it may be closed by top forming panels of a different configuration from that shown, or it may be closed by separate lid.

The numerals 34, 36, 38 and 40 denote bottom closure forming panels, foldably and integrally connected to their respective main sidewall forming panels by the indicated fold line 50 which also runs parallel to the longitudinal axis of the blank. Fold lines 23 and 50 are thus parallel.

The blank thus far described may be characterised as a rectangular slotted container blank of generally conventional construction and susceptible of formation by blank forming machines and apparatus already in extensive use.

The numeral 41 denotes generally a rectangular slip sheet of corrugated paperboard, the sheet being divided into two joined but severable sections 42 and 44 by perforated line 46, the latter being generally substantially coaxial with the indicated fold line connecting panels 12 and 14. The stippled area denotes glue which is placed on the top surface of panels 34 and 36, or alternatively, on the bottom surface of slip sheet 41. The glue areas are slightly less in area than those portions 42 and 44 which are coextensive with a respective bottom forming panel 36 and 34. As viewed in FIG. 1, sheet 41 is on top of blank 10.

The numerals 52 and 54 denote clamping edge portions of each respective slip sheet 44, 42. The glue on panels 34 and 36 does not extend above the fold line 50 and thus the lower surfaces of clamping edge portions 52 and 54 are not glued to their respective panels 12 and 14.

Referring now to FIG. 2 of the drawings, another modification is illustrated, wherein the same blank 10 is employed, but a different slip sheet construction is used. In FIG. 2, a single, non-severable slip sheet 60 is employed, with its lower surface (facing away from the reader) glued to the upper surface (facing the reader) of bottom forming panel 34 as indicated by the stippling 62. Clamping edge portion 64 of the slip sheet extends above fold line 50 and its lower surface is not glued to side forming panel 12. The other, opposite end of slip sheet 60 is denoted by the numeral 66, this designating a second clamping edge portion. Slip sheet 60 is longer the slip sheet 52 and is provided with scores to permit its folding during shipment and prior to box erection. Slip sheet 60, as will be discussed in connection with FIG. 4, extends all the way across the bottom of the erected bulk box and provides two opposite clamping edges 64 and 66.

Referring now to FIG. 3 of the drawings, the blank of FIG. 1 is shown as having been erected and partially closed. Initially, the blank 10, with its attached joined but severable slip sheets 42, 44 is formed into a flattened tube by folding about the indicated fold line separating panels 14 and 16, and attaching manufacturers flap 19 to the free edge of panel 18, in a conventional manner. This produces a flattened tube which can be erected by opening it and closing the bottom and top closure panels to form a completed and closed container. In FIG. 3, the tube has been opened, such opening being accompanied by severence along perforated line 46, to thereby define two distinct slip sheets 42 and 44. As shown at FIG. 3, the clamping edge portions 52 and 54 extend beyond their respective side walls 12 and 14. From the configuration shown as FIG. 3, the reader can readily visualize the complete formation of the bottom closure by conventionally gluing the flaps together. The top closure flap assembly 22 is closed after the container has been filled. In use, either clamping edge portion 52 or 54 may be employed to lift the bulk box, in a manner known in this art, such as shown in the above-mentioned patents to Jessen, Oster, Shimizu and Mackes. The presence of two clamping edge portions 52 and 54 permits the use of either of them, it being understood that usually only one would be used at any one time.

Figure 6:
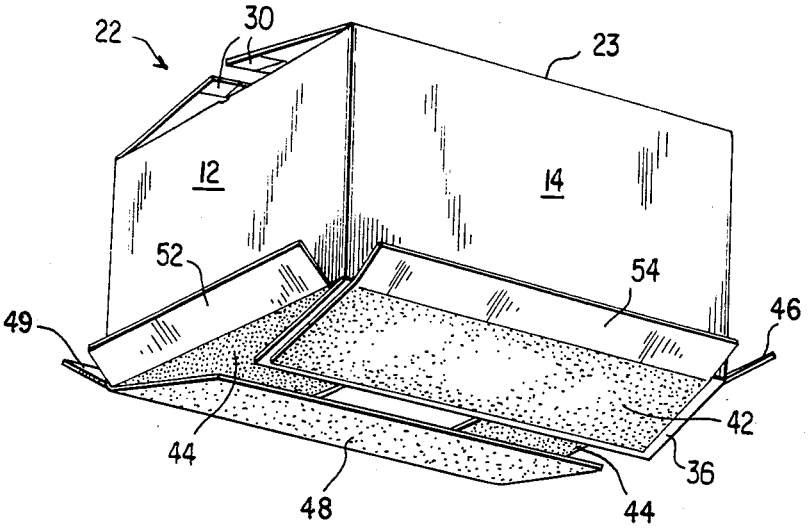
FIG. 6 is a view similar to FIG. 3 showing an embodiment wherein four slip sheets are employed.

From a consideration of FIGS. 1 and 3, the reader will readily visualize that a second joined but severable slip sheet, such as slip sheet 41 of FIG. 1, may be employed for bottom closure panels 38 and 40 to thereby provide clamping jaw edges at all four sides of the erected bulk box. It will be understood that instead of a joined but severable slip sheet 41, for the purpose of producing two clamping jaw portions 52 and 54, a single slip sheet, such as slip sheet 42 or 44 may be employed. It will further be understood that a joined but severable slip sheet, such as slip sheet 41, may extend across each of the four bottom forming panels 34, 36, 38 and 40, or across any adjacent three of them, in addition to the modifications previously described. FIG. 6 illustrates an embodiment wherein a third slip sheet, denoted as 44, and having a clamping edge 46 is glued to bottom forming panel 38 and wherein a fourth slip sheet, denoted as 48, and having a clamping edge 49 has been glued to bottom forming panel 40, to thereby yield a bulk box having a slip sheet at each of its bottom edges. Such optional, additional slip sheets, as mentioned above, may originally be single or joined to each other.

Figure 7:
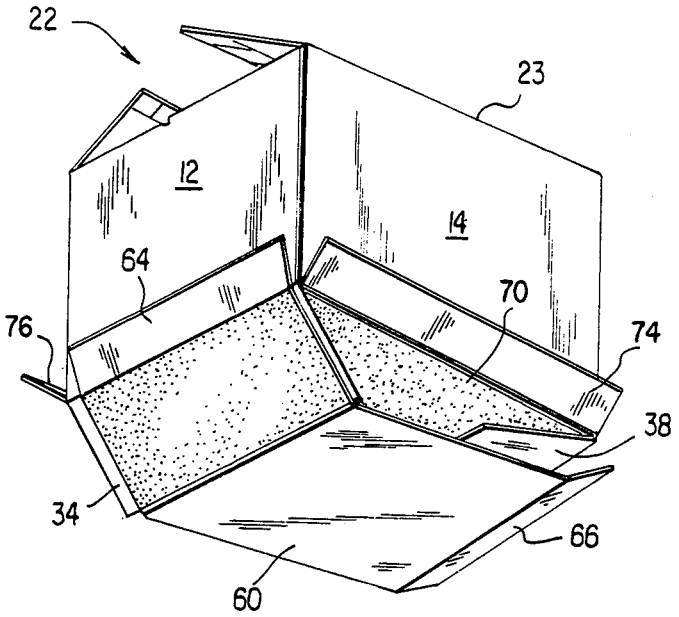
FIG. 7 is a view similar to FIG. 4 showing an embodiment wherein two longer form slip sheets are employed.

Referring now to FIG. 4 of the drawings, the box blank and slip sheet of the embodiment of FIG. 2 has been erected and partially closed. The slip sheet 60 is shown as extending from side panel 12 to opposite side panel 16 (not illustrated) with the result that opposite ends of the box each have a clamping portion, these portions being denoted by the numerals 62 and 66. From a consideration of FIGS. 2 and 4, it will be apparent that a single slip sheet, spanning the bottom of the box, may be placed on either one of the minor bottom forming panels 34 or 38, or any one of the major bottom forming panels 36 or 40. It will further be understood that a second slip sheet 70, similar in size and form to slip sheet 60 of FIG. 2, may be provided and glued to adjacent major bottom forming panel 36 to provide additional opposite clamping edges or ends 74 and 76, as ililustrated in FIG. 7. Such a second slip sheet 70 thereby yields clamping jaw edges on all four sides of the erected bulk box. Slip sheet 70 also extends all the way across the bottom of the box, at right angles to slip sheet 60. In practice, either one of these slip sheets may be the lowermost, depending on the order of folding.

Referring now to FIG. 5, another view of the box shown at FIG. 4 is given, with FIG. 5 illustrating the particular top closure construction employed according to a preferred embodiment of the invention. Each set of tabs 30 of the major panels fit into a respective slot 26, 28 of the minor panels, so as to effect top closure of the bulk box. The number of tabs in each set is shown as two, but three or more may be employed. The clamping edge portions 64 and 66 are clearly shown at FIG. 5.

In the preferred embodiment of the invention, the blank from which the bulk box is formed and the slip sheet are fashioned from corrugated paperboard. However, other sheet stock materials may be employed.

In each of the embodiments illustrated, the slip sheet is glued on that surface or those surfaces of the bottom forming panel or panels which form the exterior surface of the closed bulk box. Thus, the slip sheet forms both a support for the box and a gripping or clampable member for the purpose of pulling the loaded bulk box onto a lift truck.

What is claimed is:

1. A bulk box blank and slip sheet construction including, a one-piece, non-erected blank formed of stiff, resilient and foldable sheet stock, such as paperboard, the blank having a plurality of main, side forming panels foldably joined to each other in serial relation, each main panel having at its lower end a bottom closure forming panel having a lower free edge to thereby define a series of bottom closure forming panels, the blank adapted to be folded and erected to form a bulk box, a slip sheet, the slip sheet glued to at least one of said bottom panels in lapped relation thereto, a portion of the slip sheet extending beyond the fold which connects said at least one bottom panel to its respective side wall forming panel to thereby define a clamping edge portion of the slip sheet, whereby, after erection of the blank to form a bulk box, the clamping edge portion of the slip sheet extends beyond that side wall of the bulk box connected to said at least one bottom panel and can be clamped and pulled towards a slip sheet lifting truck to thereby assist in mounting the erected bulk box onto the slip sheet truck for subsequent transport.

2. The bulk box blank and slip sheet construction of claim 1, wherein the slip sheet extends beyond the lower, free edge of said at least one bottom forming panel to thereby define a second clamping edge portion which extends, upon erection of the box, beyond that side wall of the bulk box opposite to said at least one bottom forming panel, said two clamping edge portions being on opposite ends of said slip sheet, whereby either clamping edge portion of the slip sheet can be clamped subsequent to the erection of the blank to form a bulk box.

3. The bulk box blank and slip sheet construction of claim 1, wherein said slip sheet is glued to at least two adjacent bottom forming panels, a severable line on the slip sheet, the severable line dividing the slip sheet into two joined but severable sections, each section defining a slip sheet having a clamping edge portion, after the blank is erected to form a bulk box, each of said two adjacent bottom forming panels being thereby provided with its own slip sheet and clamping edge portion.

4. The bulk box blank and slip sheet construction of claim 1 including a second generally rectangular slip sheet, said second slip sheet glued to the external portion of a second bottom closure panel in overlapped relation thereto, said second slip sheet extending beyond the respective side wall integrally hinged to said second bottom closure panel to thereby define a second clamping jaw edge portion, the area of the second slip sheet, except for its clamping jaw edge portion, being not greater than the area of the bottom closure panel to which it is glued.

* * * * *